US010876420B2

(12) United States Patent
Rudolph

(10) Patent No.: US 10,876,420 B2
(45) Date of Patent: Dec. 29, 2020

(54) TURBINE BLADE AXIAL RETENTION AND SEALING SYSTEM

(71) Applicant: DOOSAN HEAVY INDUSTRIES & CONSTRUCTION CO., LTD., Changwon-si (KR)

(72) Inventor: Ronald Rudolph, Jensen Beach, FL (US)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 302 days.

(21) Appl. No.: 15/705,086

(22) Filed: Sep. 14, 2017

(65) Prior Publication Data

US 2019/0078454 A1 Mar. 14, 2019

(51) Int. Cl.
*F01D 11/00* (2006.01)
*F01D 5/30* (2006.01)

(52) U.S. Cl.
CPC ..... *F01D 11/006* (2013.01); *F01D 5/3007* (2013.01); *F01D 5/3015* (2013.01); *F05D 2240/55* (2013.01); *F05D 2240/80* (2013.01); *F05D 2260/30* (2013.01)

(58) Field of Classification Search
CPC .. F01D 11/006; F01D 5/3015; F01D 2240/80; F05D 2240/55; F05D 2240/80; F05D 2260/30
See application file for complete search history.

(56) References Cited

U.S. PATENT DOCUMENTS 3,266,770 A * 8/1966 Harlow ..... F01D 11/006 416/92
4,021,138 A * 5/1977 Scalzo ..... F01D 5/081 416/95
4,279,572 A * 7/1981 Auriemma ..... F01D 5/323 416/220 R
7,264,448 B2 * 9/2007 Garner ..... F01D 5/3015 416/212 R
2008/0008593 A1 1/2008 Zagar et al.
2014/0363279 A1 * 12/2014 Wondrasek ..... F01D 11/001 415/173.1
2015/0056068 A1 * 2/2015 Wiebe ..... F01D 5/06 415/173.1

(Continued)

FOREIGN PATENT DOCUMENTS

KR 2016-0063918 A 6/2016
KR 2018-0074207 A 7/2018

*Primary Examiner* — Nathaniel E Wiehe
*Assistant Examiner* — Hakeem M Abdellaoui
(74) *Attorney, Agent, or Firm* — Invenstone Patent, LLC

(57) ABSTRACT

A turbine blade retention system includes a turbine blade including a blade section and a blade platform on which the blade section is attached, the blade platform including a forward angel wing and an aft angel wing, the forward angel wing including a front blade seal groove, a disk configured to receive a plurality of the turbine blades, the disk including a front disk seal groove and an aft disk seal groove, a front seal plate, and an aft seal plate, wherein the front seal plate is slidably connectable to the turbine blade and the disk via the front blade seal groove and the front disk seal groove, and the aft seal plate is removably connectable to the turbine blade and the disk via the aft disk seal groove and a lower wall formed on the aft angel wing.

19 Claims, 7 Drawing Sheets

(56) References Cited

U.S. PATENT DOCUMENTS

| | | | | |
|---|---|---|---|---|
| 2015/0260050 | A1* | 9/2015 | Taima | F01D 11/006 416/221 |
| 2016/0273370 | A1* | 9/2016 | Belshaw | F01D 25/12 |
| 2016/0281525 | A1* | 9/2016 | Nguyen | F01D 11/04 |
| 2017/0037736 | A1* | 2/2017 | Dungs | F01D 5/3015 |

* cited by examiner

TURBINE BLADE AXIAL RETENTION AND SEALING SYSTEM

BACKGROUND

Combustors, such as those used in gas turbines, for example, mix compressed air with fuel and expel high temperature, high pressure gas downstream. The energy stored in the gas is then converted to work as the high temperature, high pressure gas expands in a turbine, for example, thereby turning a shaft to drive attached devices, such as an electric generator to generate electricity. The shaft has a plurality of turbine blades shaped such that the expanding hot gas creates a pressure imbalance as it travels from the leading edge to the trailing edge, thereby turning the turbine blades to rotate the shaft.

FIG. 1 shows a gas turbine 20. Air to be supplied to the combustor 10 is received through air intake section 30 of the gas turbine 20 and is compressed in compression section 40. The compressed air is then supplied to headend 50 through air path 60. The air is mixed with fuel and combusted at the tip of nozzles 70 and the resulting high temperature, high pressure gas is supplied downstream. In the exemplary embodiment shown in FIG. 1, the resulting gas is supplied to turbine section 80 where the energy of the gas is converted to work by turning shaft 90 connected to turbine blades 95.

In a typical industrial gas turbine ("IGT"), each turbine blade stage 95 can be in the range of about 15 feet in diameter and can weigh about 600 thousand pounds. Typically, sealing plates for large IGTs are designed to axially retain the turbine blades using both a front and aft seal plates, which does not allow the removal of the first turbine blade without lifting the casing. Given the size and weight of the turbine blades, a simpler assembly/disassembly design that provides a proper seal when assembled is needed.

BRIEF SUMMARY

In one embodiment, a turbine blade retention system comprises a turbine blade including a blade section and a blade platform on which the blade section is attached, the blade platform including a forward angel wing and an aft angel wing, the forward angel wing including a front blade seal groove, a disk configured to receive a plurality of the turbine blades, the disk including a front disk seal groove and an aft disk seal groove, a front seal plate, and an aft seal plate, wherein the front seal plate is slidably connectable to the turbine blade and the disk via the front blade seal groove and the front disk seal groove, and the aft seal plate is removably connectable to the turbine blade and the disk via the aft disk seal groove and a lower wall formed on the aft angel wing.

In another embodiment, a turbine blade retention system comprises a front seal plate configured to slidably connect to a front blade seal groove formed on a forward angel wing of a turbine blade and a front disk seal groove of a disk, and an aft seal plate configured to removably connect to a lower wall formed on an aft angel wing of the turbine blade and an aft disk seal groove of the disk, whereby the front seal plate and the aft seal plate retains the turbine blade on the disk.

In yet another embodiment, a turbine blade comprises a blade platform including a forward angel wing including a front blade seal groove and aft angel wing having a lower wall, a blade section attached to a top surface of the blade platform, and a blade attachment attached to a bottom surface of the blade platform, wherein the front blade seal groove is configured to slidably receive a front seal plate and the lower wall of the aft angel wing is configured to removably engage an aft seal plate.

DETAILED DESCRIPTION

Various embodiments of a turbine blade axial retention and sealing system in an industrial gas turbine are described. It is to be understood, however, that the following explanation is merely exemplary in describing the devices and methods of the present disclosure. Accordingly, any number of reasonable and foreseeable modifications, changes, and/or substitutions are contemplated without departing from the spirit and scope of the present disclosure.

Figure 1:
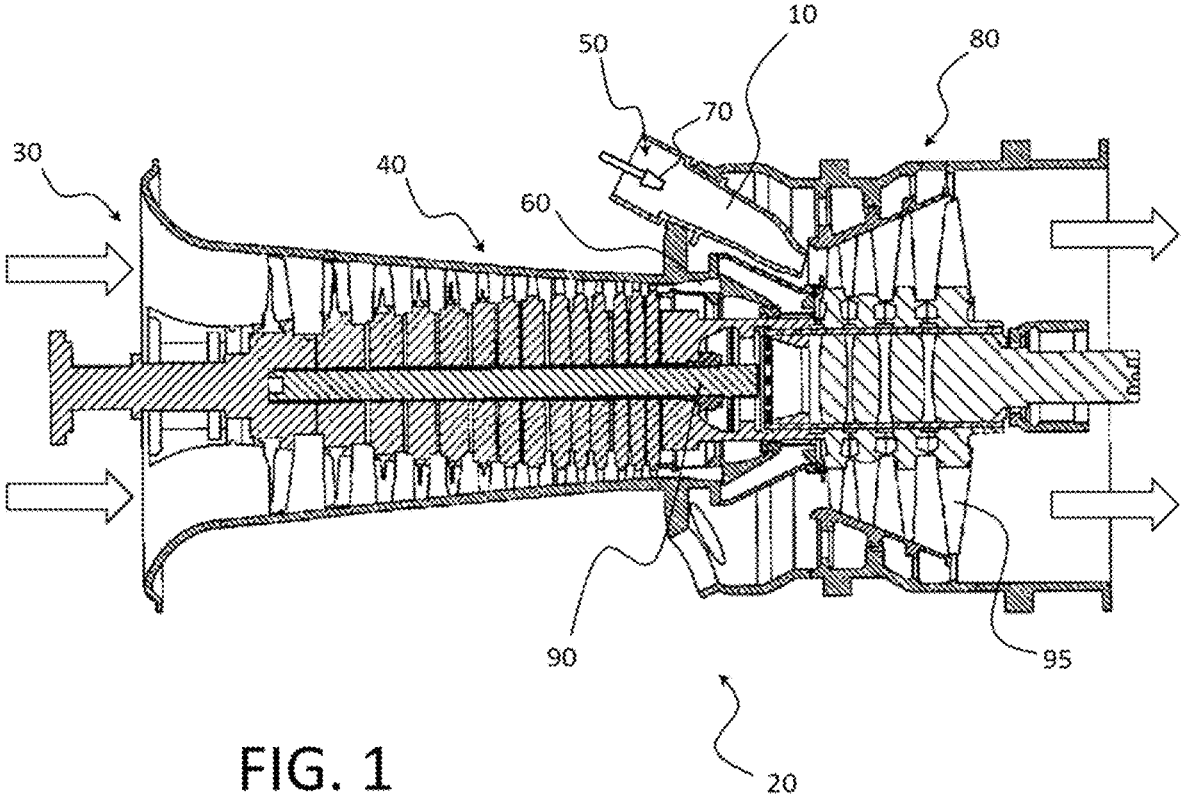
FIG. 1 is a cross sectional view of an industrial gas turbine.
Figure 2:
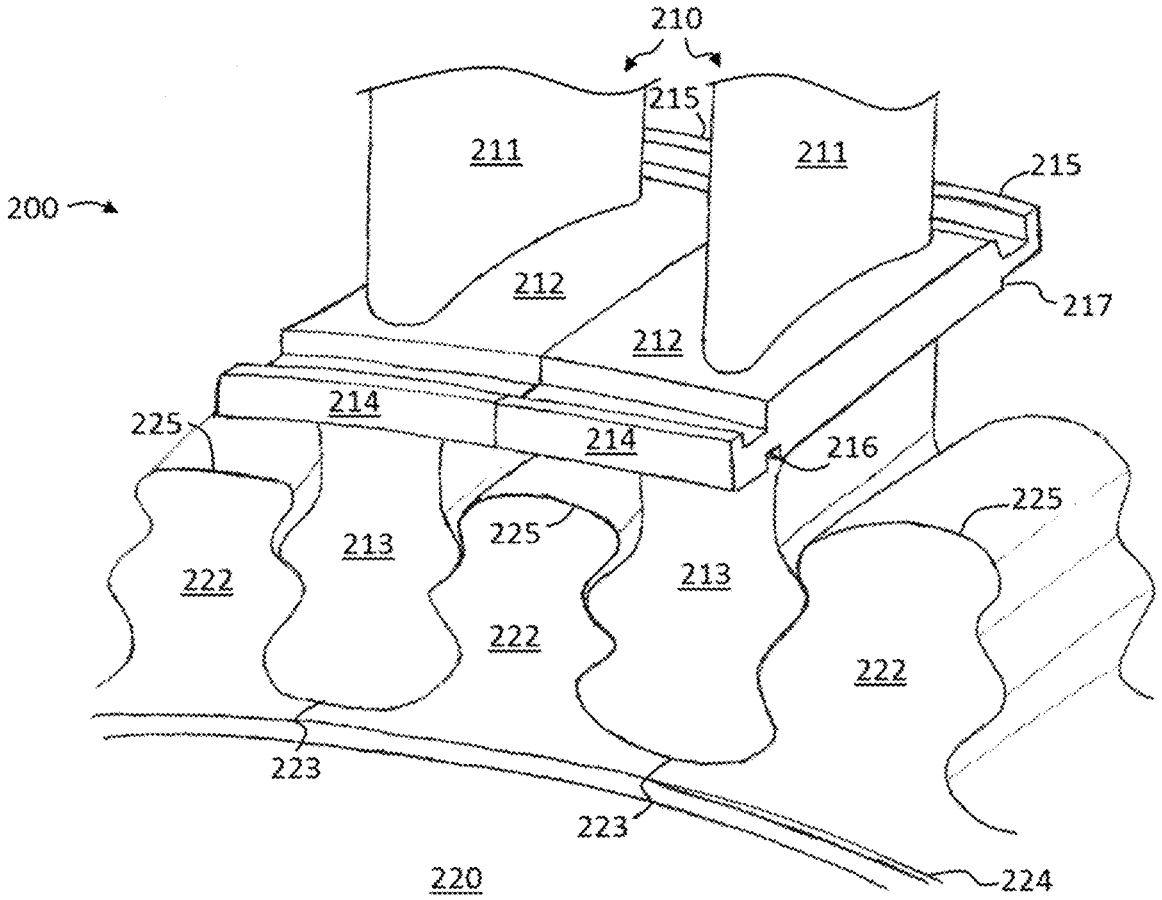
FIG. 2 is a perspective view of a turbine blade assembly according to an exemplary embodiment.

FIG. 2 is a perspective view of a turbine blade assembly according to an exemplary embodiment. Turbine blade assembly 200 of FIG. 2 is shown with two turbine blades 210 for purposes of describing the exemplary embodiment. It is to be understood that additional turbine blades are included to form a circular shape. Each of the turbine blades have identical features and therefore the detailed description will be explained with respect to turbine blade 210.

Turbine blade 210 includes blade section 211, blade platform 212, and blade attachment 213. Turbine platform 212 includes forward angel wing 214 and aft angel wing 215. Turbine platform 212 includes front blade seal groove 216 formed under forward angel wing 214 to receive a front seal plate to be described in more detail below.

Turbine blade assembly 200 further includes disk 220. Disk 220 includes a plurality of disk attachments 222 to allow turbine blade 210 to be attached to disk 220. As with the disk blades, while FIG. 2 only shows three disk attachments, it is to be understood that additional disk attachments are included along the entire outer circumferential surface of disk 220 such that turbine blades 210 are attached to the entire outer circumferential surface of disk 220. Disk 220 further includes front disk seal groove 224 and aft disk seal groove 226 (not shown) to receive a front seal plate and an aft seal plate to be described in more detail below. Front disk seal groove 224 and aft disk seal groove 226 are formed below live rim 223 of disk attachment 222.

Figure 3:
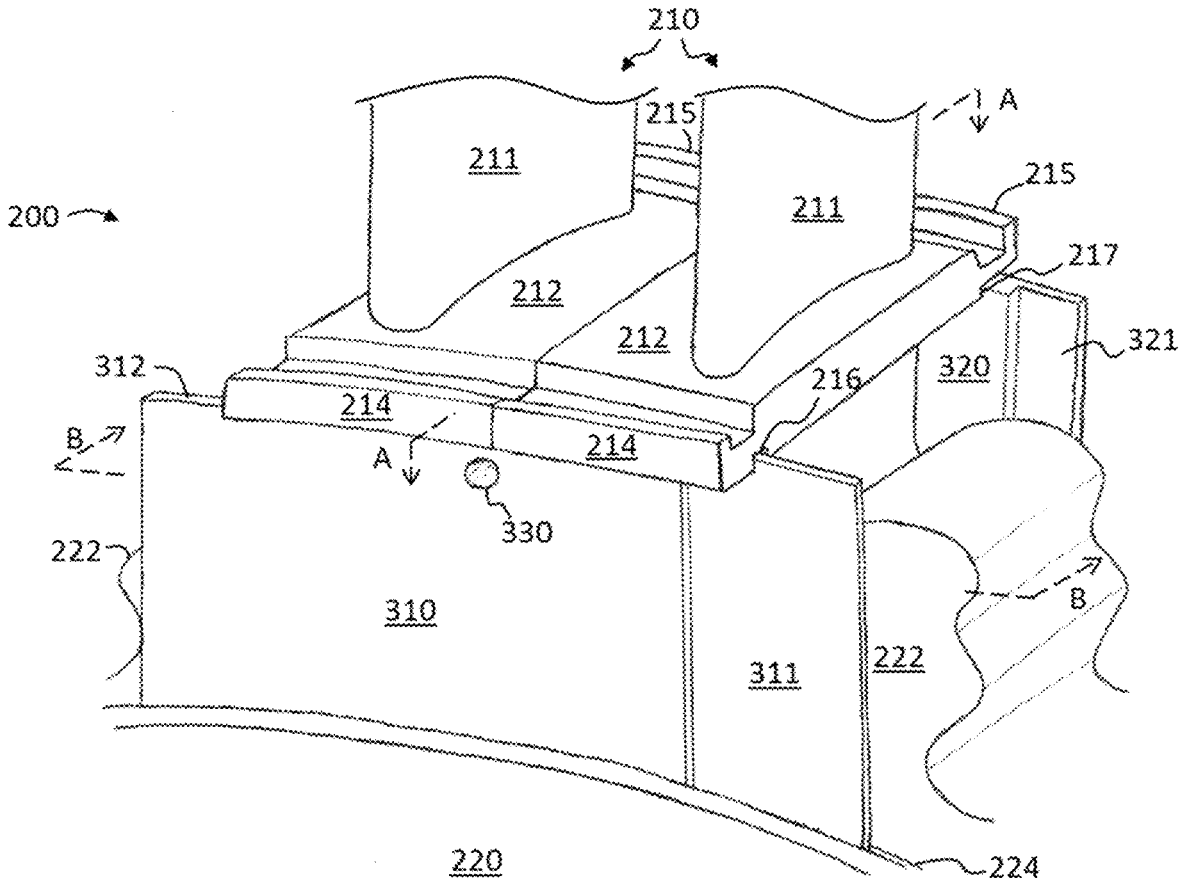
FIG. 3 is a perspective view of a turbine blade assembly according to another exemplary embodiment.
Figure 4:
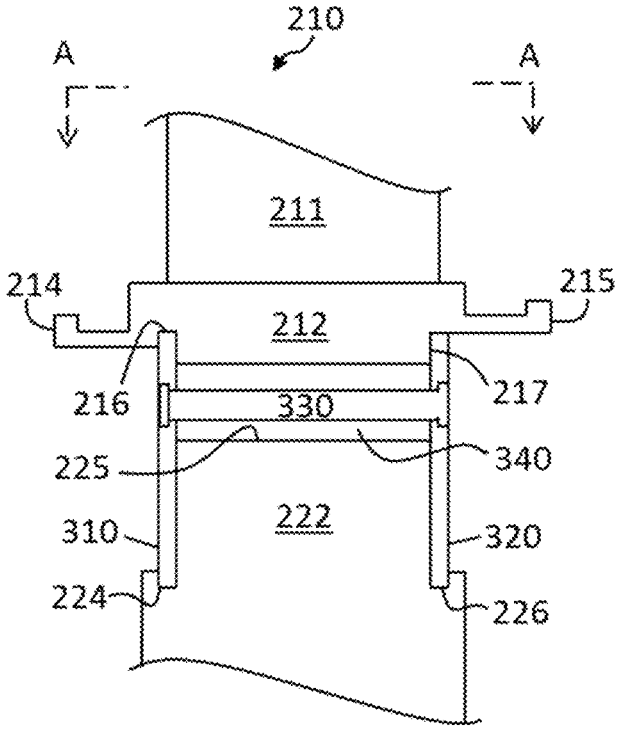
FIG. 4 is a cross-sectional view of an exemplary turbine blade assembly along cross-sectional line A-A in FIG. 3.

FIG. 3 is a perspective view of turbine blade assembly 200 with front seal plate 310 and aft seal plate 320 installed. FIG. 4 is a cross sectional view of turbine disk assembly 200 of FIG. 3 along sectional line A-A. Front seal plate 310 and aft seal plate 320 include shiplap seal ends 311, 312 and 321, 322 (not shown), respectively. The upper portion of front seal plate 310 is engaged in the front blade seal groove 216 and the lower portion of front seal plate 310 is engaged in the front disk seal groove 224. As there is no groove formed in the aft angel wing 215 of turbine platform 212, the upper portion of aft seal plate 320 engages against lower wall 217 of aft angel wing 215 while the lower portion of aft seal plate 320 is engaged in the aft disk seal groove 226.

Aft seal plate 320 is held in place by connecting pin 330 that connects front seal plate 310 and aft seal plate 320 through a vacant space 340 formed between the bottom portion of blade platform 212 and dead rim 225 of disk attachment 222. In an exemplary embodiment, one end of connecting pin 330 may be permanently attached to aft seal plate 320 and the other end of connecting pin 330 may be removably attached to front seal plate 310 such as by bolt and nut combination. Other connection mechanisms for connecting pin 330 may be used to facilitate connection of front seal plate 310 to aft seal plate 320 without departing from the scope of the present disclosure.

Figure 5:
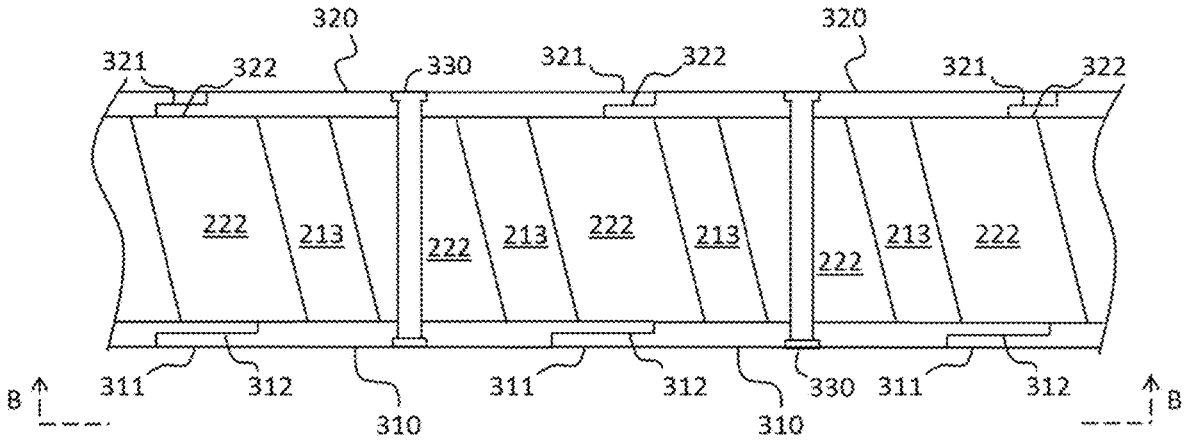
FIG. 5 is a cross-sectional view of an exemplary turbine blade assembly along cross-sectional line B-B in FIG. 3.

FIG. 5 is a cross sectional view of turbine disk assembly 200 of FIG. 3 along sectional line B-B showing two sets of front seal plate 310 and aft seal plate 320 retaining four turbine blades indicated by four blade attachments 213. When two front seal plates 310 are coupled, shiplap seal end 311 of one front seal plate 310 overlap with shiplap seal end 312 of another front seal plate 310 to provide a seal at the joining boundary of the two front seal plates 310. Likewise, when two aft seal plates 320 are coupled, shiplap seal end 321 of one aft seal plate 320 overlap with shiplap seal end 322 of another front seal plate 320 to provide a seal at the joining boundary of the two aft seal plates 320.

Figure 6A:
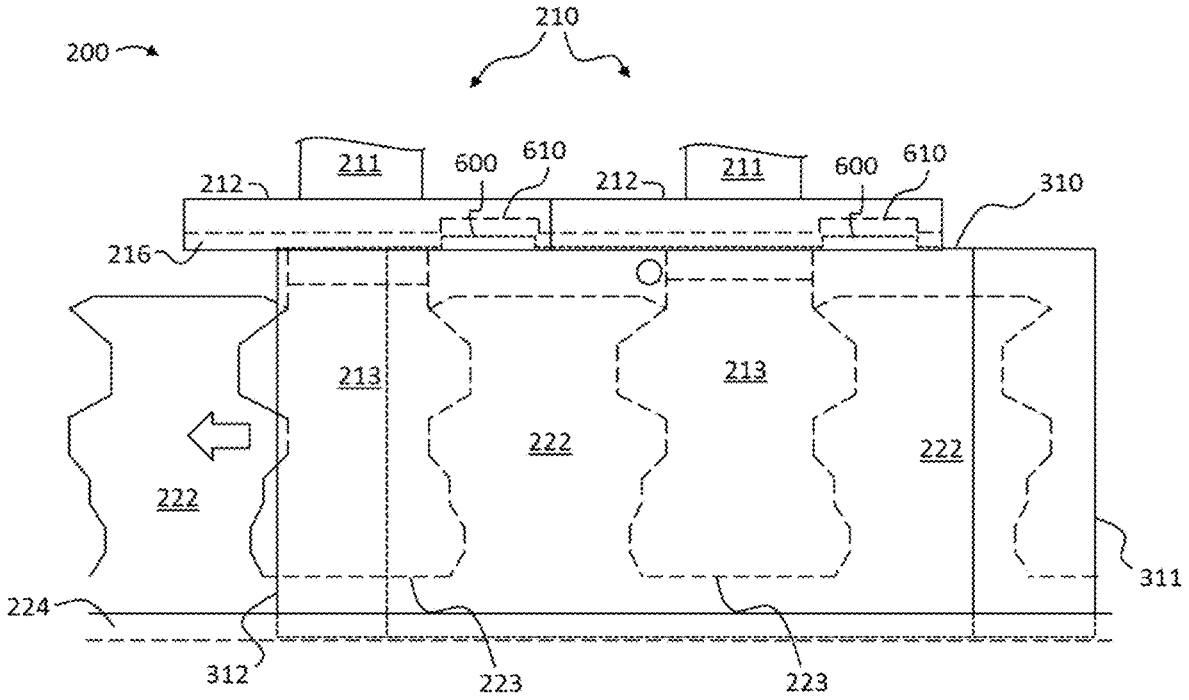
FIGS. 6A and 6B are front views of a turbine blade assembly according to another exemplary embodiment.
Figure 6B:
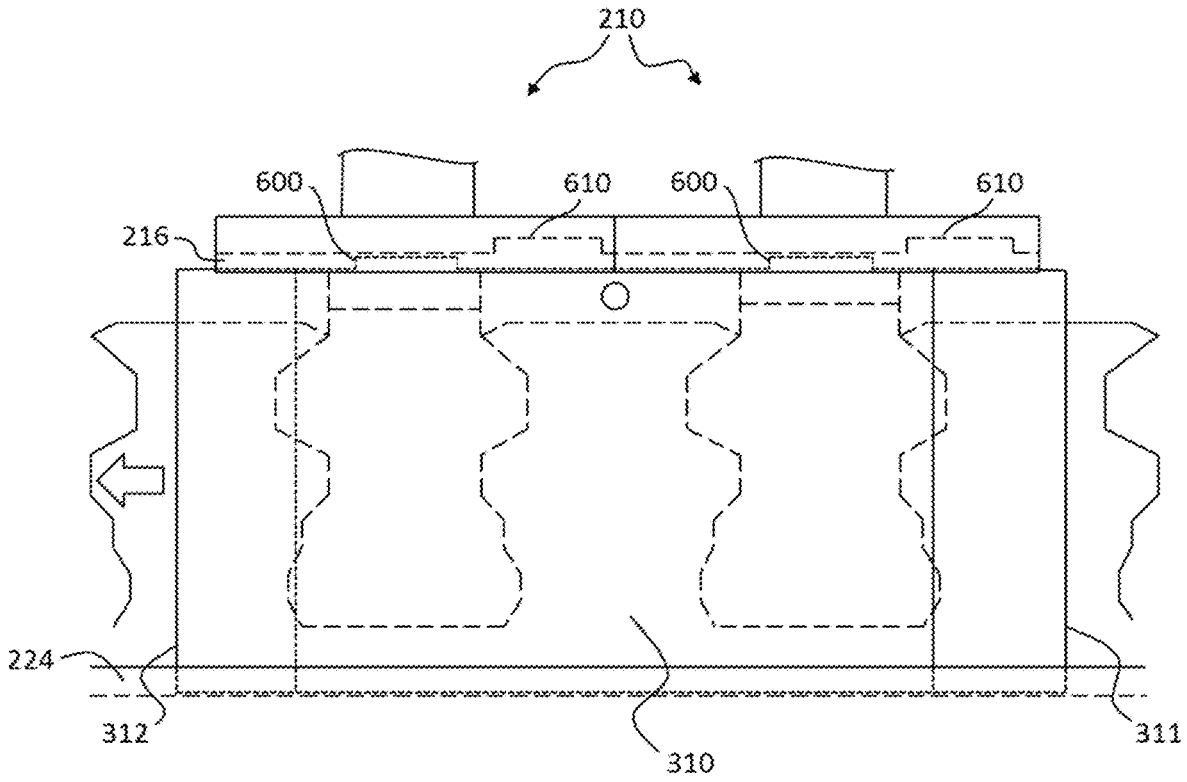

FIG. 6 is a frontal view of turbine blade assembly 200. In an exemplary embodiment, front seal plate 310 includes scalloped portions 600 at the upper surface of front seal plate 310. These scalloped portions 600 allows front seal plate 310 to slide along front blade seal groove 216 to lock in the front seal plate 310 or unlock the front seal plate 310 for later removal. Specifically, front blade seal groove 216 includes lifting slots 610. To install front seal plate 310, scalloped portions 600 are positioned at the location of lifting slots 610 and lifted into the lifting slots 610 to place the upper portion of front seal plate 310 into front blade seal groove 216. When front seal plate 310 is released, the lower portion of front seal plate 310 is placed into front disk seal groove 224. Once positioned in the front blade seal groove 216 and front disk seal groove 224, front seal plate 310 is rotated in the counterclockwise direction. As shown in FIG. 6B, when front seal plate 310 is rotated, scalloped portions 600 slides past lifting slots 610 thereby locking the front seal plate 310 into place. Thereafter, aft seal plate 320 is positioned behind front seal plate 310 and are coupled together via connection pin 330, thereby retaining turbine blades 210 while providing a seal. To remove a front seal plate 310, the installation steps are performed in reverse, allowing easy removal of any turbine blade without having to remove the entire casing. The length of shiplap seal ends 311 and 312 of front seal plate 310 are sized so that as adjacent seal plates are rotated, the front seal plate for installation or removal can be rotated to engage or disengage the axial retention tabs.

The breadth and scope of the present disclosure should not be limited by any of the above-described exemplary embodiments, but should be defined only in accordance with the following claims and their equivalents. For example, while the exemplary embodiments above are disclosed as covering and retaining two turbine blades at a time to reduce leakage of cooling fluid and other advantages, the size of the seal plates in accordance with the present disclosure may be changed to cover a single turbine blade or more than two turbine blades at a time without departing from the disclosed scope. Further, the width of the shiplap seal ends of the front seal plates may be the same as that of the aft seal plates or varied without departing from the scope of the present disclosure. Still further, while the present disclosure describes using shiplap seal ends of the front and aft seal plates to provide both an improved retention and sealing performance, other sealing mechanisms between the adjacent seal plates may be employed without departing from the disclosed scope. Moreover, the above advantages and features are provided in described embodiments, but shall not limit the application of the claims to processes and structures accomplishing any or all of the above advantages.

Additionally, the section headings herein are provided for consistency with the suggestions under 37 CFR 1.77 or otherwise to provide organizational cues. These headings shall not limit or characterize the invention(s) set out in any claims that may issue from this disclosure. Further, a description of a technology in the "Background" is not to be construed as an admission that technology is prior art to any invention(s) in this disclosure. Neither is the "Brief Summary" to be considered as a characterization of the invention (s) set forth in the claims found herein. Furthermore, any reference in this disclosure to "invention" in the singular should not be used to argue that there is only a single point of novelty claimed in this disclosure. Multiple inventions may be set forth according to the limitations of the multiple claims associated with this disclosure, and the claims accordingly define the invention(s), and their equivalents, that are protected thereby. In all instances, the scope of the claims shall be considered on their own merits in light of the specification, but should not be constrained by the headings set forth herein.

What is claimed is:

1. A turbine blade retention system, comprising:

a disk including a front disk seal groove formed in a front outer circumferential surface of the disk and an aft disk seal groove formed in an aft outer circumferential surface of the disk;

a turbine blade configured to be installed on an outer periphery of the disk, the turbine blade including a blade section and a blade platform on which the blade section is attached, the blade platform including a forward angel wing and an aft angel wing, the forward angel wing including a front blade seal groove, the front blade seal groove including a frontward facing surface and an aftward facing surface, the aft angel wing including an aftward facing lower wall that is open in an axial direction of the disk;

a front seal plate including a radial outward end;

an aft seal plate including a radial outward end; and a connecting pin configured to connect the front seal plate and the aft seal plate to each other, fix the turbine blade to the disk, and hold the aft seal plate against the aftward facing lower wall, wherein the front seal plate is slidably connectable to the turbine blade and the disk via the front blade seal groove and the front disk seal groove by the radial outward end of the front seal plate being received between the frontward and aftward facing surfaces of the front blade seal groove, and the aft seal plate is removably connectable to the turbine blade and the disk via the aft disk seal groove and the aftward facing lower wall of the aft angel wing by the radial outward end of the aft seal plate being inserted in the axial direction and seated against the aftward facing lower wall.

2. The turbine blade retention system of claim 1, wherein the front seal plate includes a first front plate shiplap seal and a second front plate shiplap seal.

3. The turbine blade retention system of claim 2, wherein the first front plate shiplap seal of one front seal plate is configured to connect to the second front plate shiplap seal of another front seal plate.

4. The turbine blade retention system of claim 1, wherein the aft seal plate includes a first aft plate shiplap seal and a second aft plate shiplap seal.

5. The turbine blade retention system of claim 4, wherein the first aft plate shiplap seal of one aft seal plate is configured to connect to the second aft plate shiplap seal of another aft seal plate.

6. The turbine blade retention system of claim 1, wherein the connector pin is attachable to the front seal plate and the aft seal plate through a vacant space formed between the blade platform and a disk attachment of the disk.

7. The turbine blade retention system of claim 1, wherein the front seal plate further includes a scalloped section configured to slidably engage the front blade seal groove.

8. The turbine blade retention system of claim 7, wherein the blade platform further includes a lifting slot configured to accommodate the scalloped section of the front seal plate during attachment or removal of the front seal plate.

9. The turbine blade retention system of claim 1, wherein the connecting pin includes a first end and a second end opposite to the first end, the first end permanently attached to the aft seal plate and the second end configured to be removably attached to the front seal plate.

10. The turbine blade retention system of claim 1, wherein the outer periphery of the disk includes at least one disk attachment to receive the turbine blade, the at least one disk attachment disposed between a live rim and a dead rim, and wherein each of the front disk seal groove and the aft disk seal groove is formed below the live rim of the at least one disk attachment.

11. A turbine blade retention system, comprising:

a turbine blade configured to be installed on an outer periphery of a disk including a front disk seal groove formed in a front outer circumferential surface of the disk and an aft disk seal groove formed in an aft outer circumferential surface of the disk;

a front seal plate including a radial outward end, the front seal plate configured to slidably connect to a front blade seal groove formed on a forward angel wing of the turbine blade and to the front disk seal groove of the disk by the radial outward end of the front seal plate being received between frontward and aftward facing surfaces of the front blade seal groove;

an aft seal plate including a radial outward end, the aft seal plate configured to removably connect to a lower wall formed on an aft angel wing of the turbine blade and to the aft disk seal groove of the disk by the radial outward end of the aft seal plate being inserted in an axial direction of the disk and seated against the lower wall, the lower wall of the aft angel wing facing aftward and being open in the axial direction; and a connecting pin configured to connect the front seal plate and the aft seal plate to each other, fix the turbine blade to the disk, and hold the aft seal plate against the aftward facing lower wall.

12. The turbine blade retention system of claim 11, wherein the front seal plate includes a first front plate shiplap seal and a second front plate shiplap seal.

13. The turbine blade retention system of claim 12, wherein the first front plate shiplap seal of one front seal plate is configured to connect to the second front plate shiplap seal of another front seal plate.

14. The turbine blade retention system of claim 11, wherein the aft seal plate includes a first aft plate shiplap seal and a second aft plate shiplap seal.

15. The turbine blade retention system of claim 14, wherein the first aft plate shiplap seal of one aft seal plate is configured to connect to the second aft plate shiplap seal of another aft seal plate.

16. The turbine blade retention system of claim 11, wherein the front seal plate further includes a scalloped section configured to slidably engage the front blade seal groove.

17. A turbine blade, comprising:

a blade platform including a forward angel wing including a front blade seal groove, and aft angel wing having a lower wall;

a blade section attached to a top surface of the blade platform; and a blade attachment attached to a bottom surface of the blade platform, wherein the front blade seal groove is configured to slidably receive a front seal plate and the lower wall of the aft angel wing is configured to removably engage an aft seal plate, wherein the aft seal plate is placed in place by a connector pin that connects the front seal plate and the aft seal plate, and wherein the blade platform further includes a lifting slot configured to accommodate a scalloped section of the front seal plate during attachment or removal of the front seal plate to or from the turbine blade.

18. The turbine blade of claim 17, wherein the blade attachment is configured to slidably engage a plurality of disk attachments of a disk to form a turbine assembly.

19. The turbine blade of claim 17, wherein the bottom surface of the blade platform and one of the plurality of disk attachments of the disk define a vacant space through which the connector pin is attachable to the front seal plate and the aft seal plate.

* * * * *